US008136604B2

(12) United States Patent
Jennings

(10) Patent No.: US 8,136,604 B2
(45) Date of Patent: Mar. 20, 2012

(54) WIRELINE RUN FRACTURE ISOLATION SLEEVE AND PLUG AND METHOD OF OPERATING SAME

(75) Inventor: Charles E. Jennings, Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 397 days.

(21) Appl. No.: 12/403,547

(22) Filed: Mar. 13, 2009

(65) Prior Publication Data

US 2010/0230114 A1 Sep. 16, 2010

(51) Int. Cl.
*E21B 33/068* (2006.01)

(52) U.S. Cl. ..... 166/382; 166/177.5; 166/75.14

(58) Field of Classification Search ..... 166/386, 166/86.1, 82.1, 75.11, 177.5, 382, 75.14
See application file for complete search history.

(56) References Cited

U.S. PATENT DOCUMENTS

| | | | |
|---|---|---|---|
| 5,819,851 | A | 10/1998 | Dallas |
| 5,975,211 | A | 11/1999 | Harris |
| 6,516,861 | B2 | 2/2003 | Allen |
| 6,810,954 | B2 | 11/2004 | Garrett et al. |
| 7,040,412 | B2 | 5/2006 | DeBerry |
| 7,308,934 | B2 | 12/2007 | Swagerty et al. |
| 2003/0205385 | A1 | 11/2003 | Duhn et al. |
| 2006/0185841 | A1 | 8/2006 | Swagerty et al. |
| 2011/0114321 | A1 * | 5/2011 | Guidry et al. ..... 166/308.1 |

OTHER PUBLICATIONS

U.S. Appl. No. 11/867,086, filed Oct. 4, 2007, entitled "Wellhead Isolation Sleeve Assembly" Inventors: Kwong Onn Chan, Henry X. He, Eugene A. Borak, Jr.

* cited by examiner

*Primary Examiner* — David Andrews
(74) *Attorney, Agent, or Firm* — Bracewell & Giuliani LLP

(57) ABSTRACT

An isolation sleeve and plug assembly that may be used to protect a wellhead assembly from being damaged by high-pressure wellbore fracturing operations. Both the isolation sleeve and plug may be installed by the same running tool, and may be installed by lowering the running tool through an isolation valve on the wellbore.

25 Claims, 9 Drawing Sheets

WIRELINE RUN FRACTURE ISOLATION SLEEVE AND PLUG AND METHOD OF OPERATING SAME

BACKGROUND OF THE INVENTION

1. Field of the Invention

The present invention relates in general to an improved wellbore fracturing system, and in particular to an improved wellhead fracture isolation system.

2. Brief Description of Related Art

Producing from a well frequently involves drilling a wellbore into rock formations. It is sometimes necessary to fracture the subterranean rock formations to facilitate release of the fluids from the rock. One method of fracturing is to seal the top of the well and then inject high pressure liquid or gas into the well. The wellhead, which includes the valve assembly through which the production fluid flows, may not be able to withstand the high pressures required to fracture the rock. It is desirable to isolate the wellhead members from the wellbore during fracturing operations. It is also desirable to efficiently insert and extract the wellbore isolation devices.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE INVENTION

Figure 1:
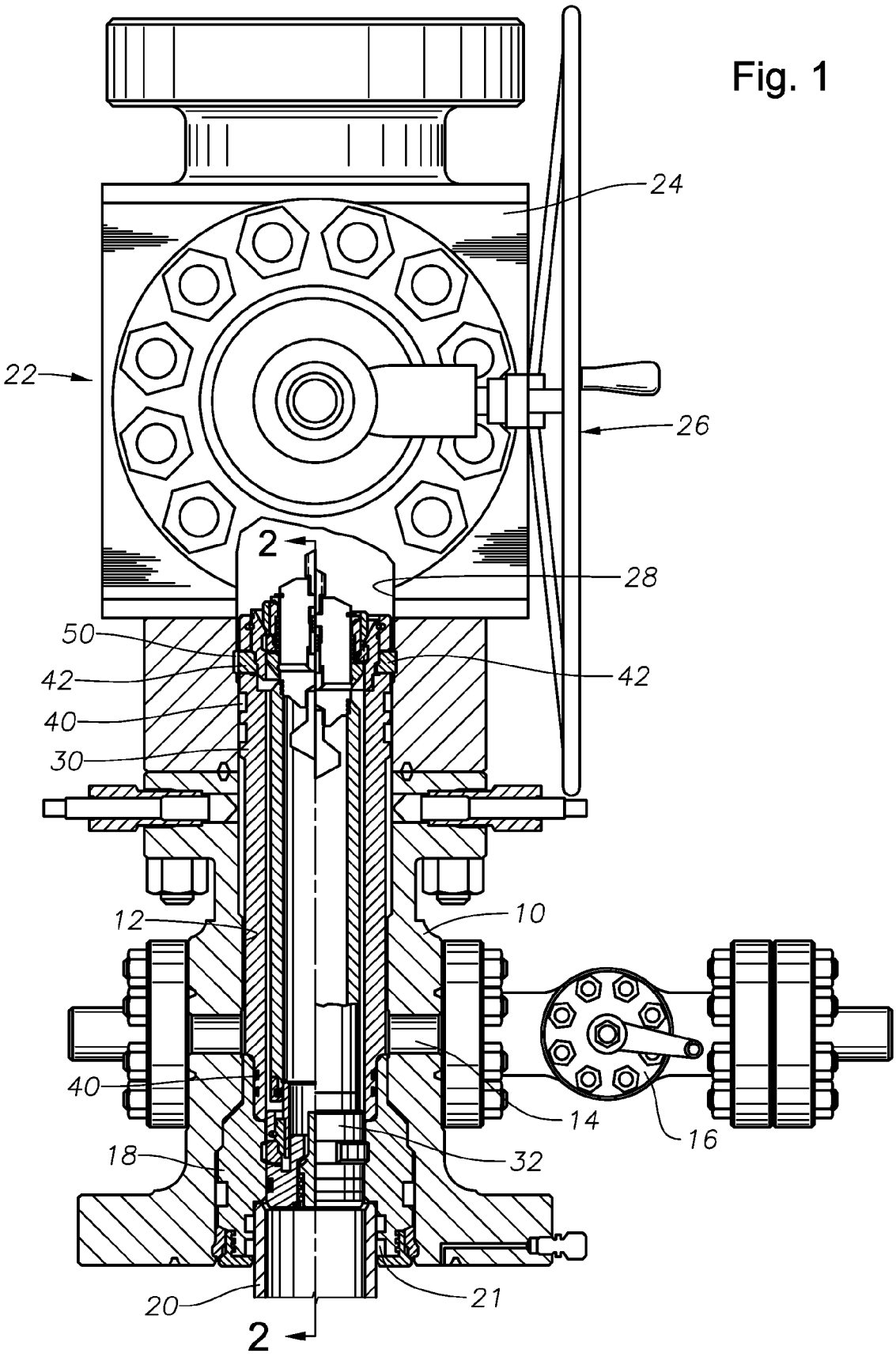
FIG. 1 is a split sectional view of a wellhead with a fracture isolation valve, sleeve, seal sub, and plug; the left side of the wellbore shows a quarter-sectional view of the isolation sleeve and the right side of the wellbore shows a plug without an isolation sleeve.

Referring to FIG. 1, a wellhead assembly, also referred to as a tubing head 10 has a bore 12 extending vertically through it. The tubing head 10 has one or more production outlets 14 that extend laterally from it for the flow of well fluid during production. The production outlets 14 lead to one or more production valves 16, through which the production fluid exits the wellbore. The upper end of a tubing hanger seal sub 18, also known as a seal adapter 18, extends upward into bore 12. The seal adapter sits on top of the well conduit, such as casing 20 or casing (not shown). After well completion, a string of tubing (not shown) is suspended inside the casing 20. One or more seals 21 form a seal between the casing 20 and the seal sub 18. The casing 20 is supported by a casing hanger (not shown).

To perform a fracturing operation, an adapter assembly 22 is mounted on the tubing head 10. In this example, adapter assembly 22 has an integral, solid body 24 that includes components of a gate valve 26. A passage or bore 28 extends vertically through body 24 in coaxial alignment with wellhead bore 12. Adapter body 24 has a transverse gate cavity (not shown) that intersects and is perpendicular to bore 28.

Gate valve 26 may be opened to provide vertical access to bore 12. The gate valve 26 may be used to introduce a fracture isolation sleeve 30 into bore 12. The isolation sleeve 30 is used to seal off components of the tubing head 10 that could be damaged by high pressure wellbore fracturing operations. Production valve 16, for example, may be rated for only 5000 p.s.i., and therefore unable to withstand the 6000-15,000 p.s.i. required for wellbore fracturing.

Similarly, gate valve 24 may be used to provide access to insert a wellbore plug 32 into the seal adapter 18. The wellbore plug 32 may be used to plug the wellbore so that high pressure in the casing 20 is contained below the seal adapter 18. The plug 32, like the isolation sleeve 30, protects the wellhead components from the high pressure of fracturing operations.

The isolation sleeve 30, the plug 32, and the tools used to install them will be described individually, followed by an operational description of the installation and removal process.

Isolation Sleeve Description:

Referring to FIG. 1, the isolation sleeve ("IS") 30 is a bushing with an outer diameter ("OD") that is smaller than the inner diameter ("ID") of the wellhead bore 12. The ID of the IS 30 is large enough for the plug 32 to pass through the IS 30.

Figure 2:
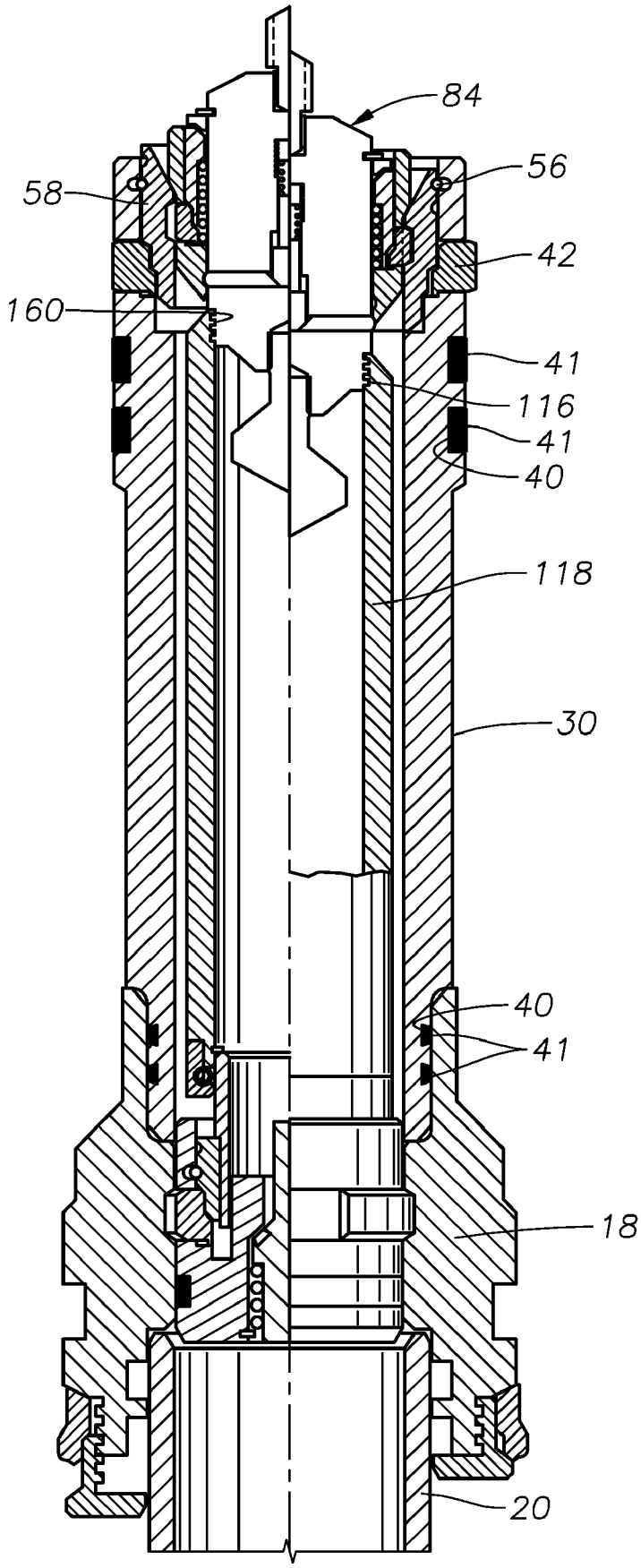
FIG. 2 is a vertical sectional view of the isolation sleeve and plug of FIG. 1.
Figure 3:
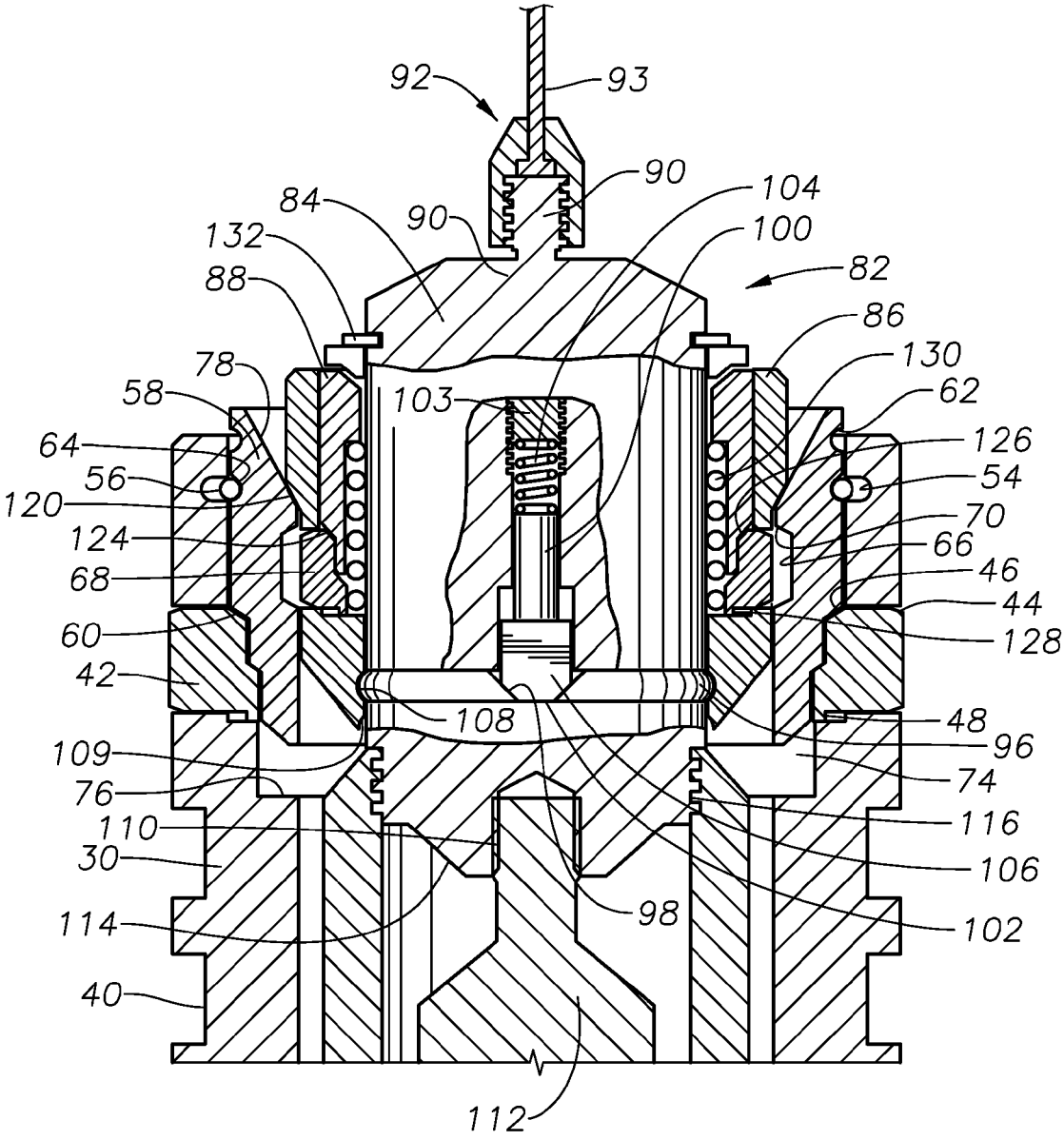
FIG. 3 is a sectional view of the top portion of the isolation sleeve and the running tool of FIG. 1.

Referring to FIG. 2, the IS 30 has one or more sealing ring grooves 40 on its OD. Referring to FIG. 3, one or more IS locking members ("IS lock dogs") 42 are located in separate windows around the circumference of the IS 30. Each IS lock dog 42 is a metallic block with a taper 44 on the top outer edge, a taper 46 on the top inner edge, and a tab 48 on the bottom. In the retracted position, the outer edge of each IS lock dog 42 is flush with the OD of the IS 30. In the extended position, the outer edge of each IS lock dog 42 protrudes from the OD of IS 30 to engage a groove 50 (FIG. 1) in the gate valve bore 28 (FIG. 1).

The ID of the IS 30 has a retainer ring groove 54 that contains an IS retainer ring 56, which may be a snap ring. In its relaxed state, the IS retainer ring 56 protrudes from the retainer ring groove 54 toward the ID.

The ID of the IS 30 has a lock sleeve 58, which is an annular ring that can slide from an upper position (shown on the left side of FIG. 2) to a lower position (shown on the right side of FIG. 2). The OD of the lock sleeve 58 has one or more tapers 60 that push the IS dogs 42 from the retracted position to the extended position. The OD of lock sleeve 58 also has an upper detent groove 62 and a lower detent groove 64, each of which is capable of receiving snap ring 56.

Figure 5:
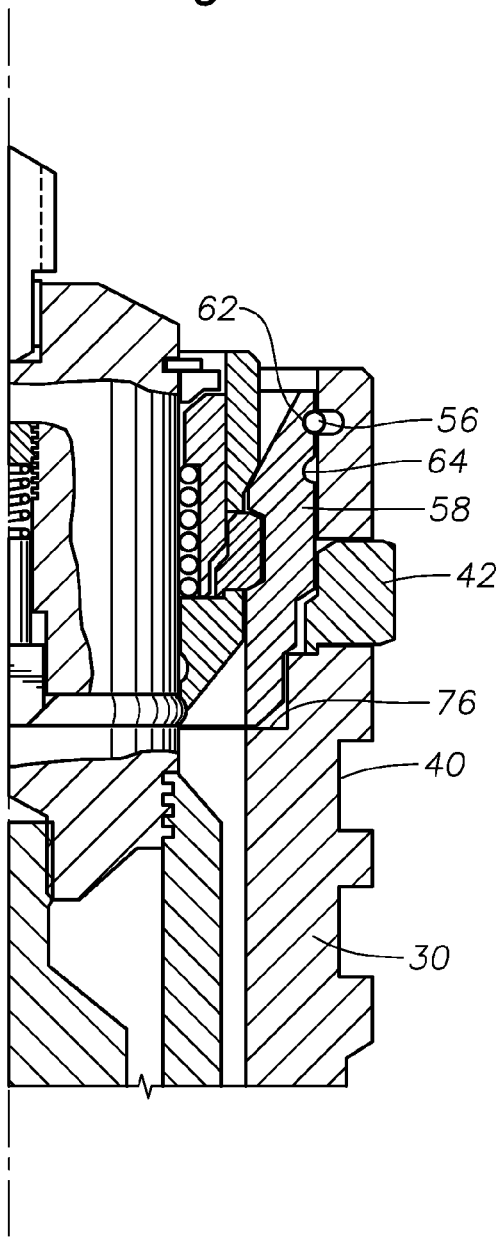
FIG. 5 is a quarter sectional view of the isolation sleeve and running tool of FIG. 1, showing running tool locked into the isolation sleeve and the isolation sleeve in the locked position.

The ID of the lock sleeve 58 has an RT dog groove 66, which is a groove that can receive a running tool locking element 68. The upper edge of the RT dog groove 66 has a chamfered surface 70. The ID of the lock sleeve 58 is the same as the smallest ID of the IS 30. The lock sleeve 58 moves up and down within the lock sleeve counterbore 74. The IS retainer ring 56 snaps into the lower groove 64 when the lock sleeve 58 is in the upper position (as shown in FIG. 3), and snaps into the upper groove 62 when the lock sleeve 58 is in the lower position (FIG. 5). The downward travel of the lock sleeve 58 is limited by the lock sleeve groove shoulder 76 on the lower edge. The ID of the lock sleeve 58 also has a tapered running tool engagement surface 78 that slopes down and in from the top of the lock sleeve 58.

Figure 4:
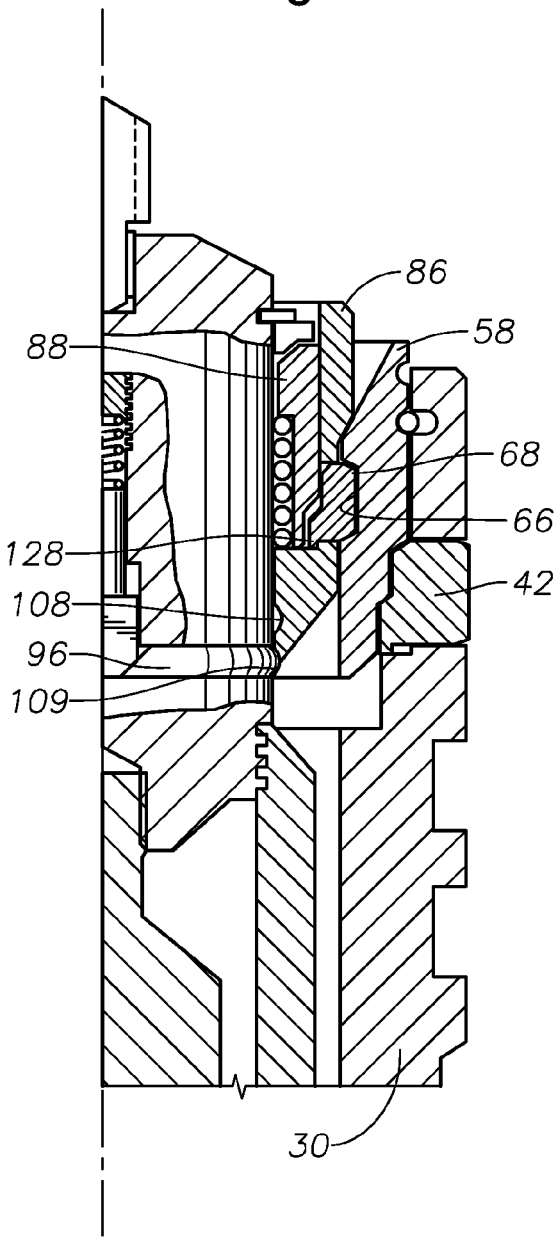
FIG. 4 is a quarter sectional view of the isolation sleeve and running tool of FIG. 1, showing the running tool locked into the isolation sleeve and the isolation sleeve in an unlocked position.

Running Tool Description:

Referring to FIG. 3, the running tool assembly ("RT") 82 comprises a running tool inner body 84, an outer sleeve 86, and a lock cam sleeve 88. The RT inner body 84 has a top connector 90, that could be a threaded connector, for receiving a cable adapter 92 connected to a cable 93 used to lower the running tool 82 and IS 30 into tubing head 10 and seal adapter 18 (FIG. 1). Alternatively, the top connector 90 could be attached to a rod (not shown). The top connector 90 could comprise male threads as shown in FIG. 3, or female threads as shown in FIGS. 4 and 5.

The RT inner body 84 has a locking c-ring 96 around its OD. The abutting ends 98 of the locking c-ring 96 are tapered such that when viewing a profile of the c-ring, the ends are closest at the bottom of the c-ring and furthest at the top of the c-ring. The amount of force required to adjust the locking c-ring 96 can be adjusted by the c-ring lock 100. In an exemplary embodiment, the c-ring lock 100 is a screw that is axially aligned with the RT inner body 84 and located in a vertical bore near the OD of the RT inner body 84. The bore is centered on the c-ring gap 102. Tightening the c-ring lock screw 103 applies force on a spring 104, which pushes a wedge 106 into the taper 98, causing the locking c-ring 96 to expand. Alternative embodiments to adjust the tension on the locking c-ring may be used. The locking c-ring 96 can fit into an upper groove 108 on the lower portion of the RT outer sleeve 86, or it can fit just under the lower edge 109 of the RT outer sleeve 86. FIG. 4 shows c-ring 96 engaging lower edge 109.

Referring to FIG. 3, the bottom of RT inner body 84 has a threaded connector 110 for receiving a weight 112. The OD of the RT inner body 84, on the straight-wall side above the lower taper 114, may have threads 116 for receiving the plug adapter tool 118 (FIG. 2).

The RT outer sleeve 86 is a hollow cylinder around the OD of the RT inner body 84. It has an IS engagement surface 120 that engages the tapered ID 78 on the IS lock sleeve 58. The RT inner body 84 is able to slidingly move from an upper position to a lower position, relative to the RT outer sleeve 86. In the upper position (FIG. 3), locking c-ring 96 engages upper groove 108. In the lower position (FIG. 4), locking c-ring engages lower edge 109.

As mentioned, the RT outer sleeve 86 contains one or more RT locking members ("RT lock dogs") 68, each located within a window. Each RT lock dog 68 is a metal block with an outer taper 124, and inner taper 126, and a tab 128. The RT lock dogs could be made of another material. RT lock dogs 68 can move from a retracted position, flush with the OD of the RT outer sleeve 86 (FIG. 3), to an extended position, wherein each engages the RT dog groove 66 on the IS lock sleeve 58. The tab 128 engages a lip on the RT outer sleeve 86 to prevent the RT lock dog 68 from hyper-extending.

The RT lock dogs 68 are pushed from the retracted position to the extended position by downward movement of the RT lock cam 88. The RT lock cam 88 is a cylinder between the RT inner body 84 and the RT outer sleeve 86. A cam return spring 130 biases the RT lock cam 88 to an upper position, shown in FIG. 3. A lock cam retainer 132, which is a retainer or split ring on the RT inner body 84, contacts the top edge of the lock cam 88. As the RT inner body 84 pushes down on the lock cam 88, the lock cam 88 compresses cam return spring 130 and pushes RT lock dogs 68 from the retracted position to the extended position. FIG. 3 shows RT lock dogs 68 retracted, while FIG. 4 shows the RT lock dogs 68 extended.

Figure 6:
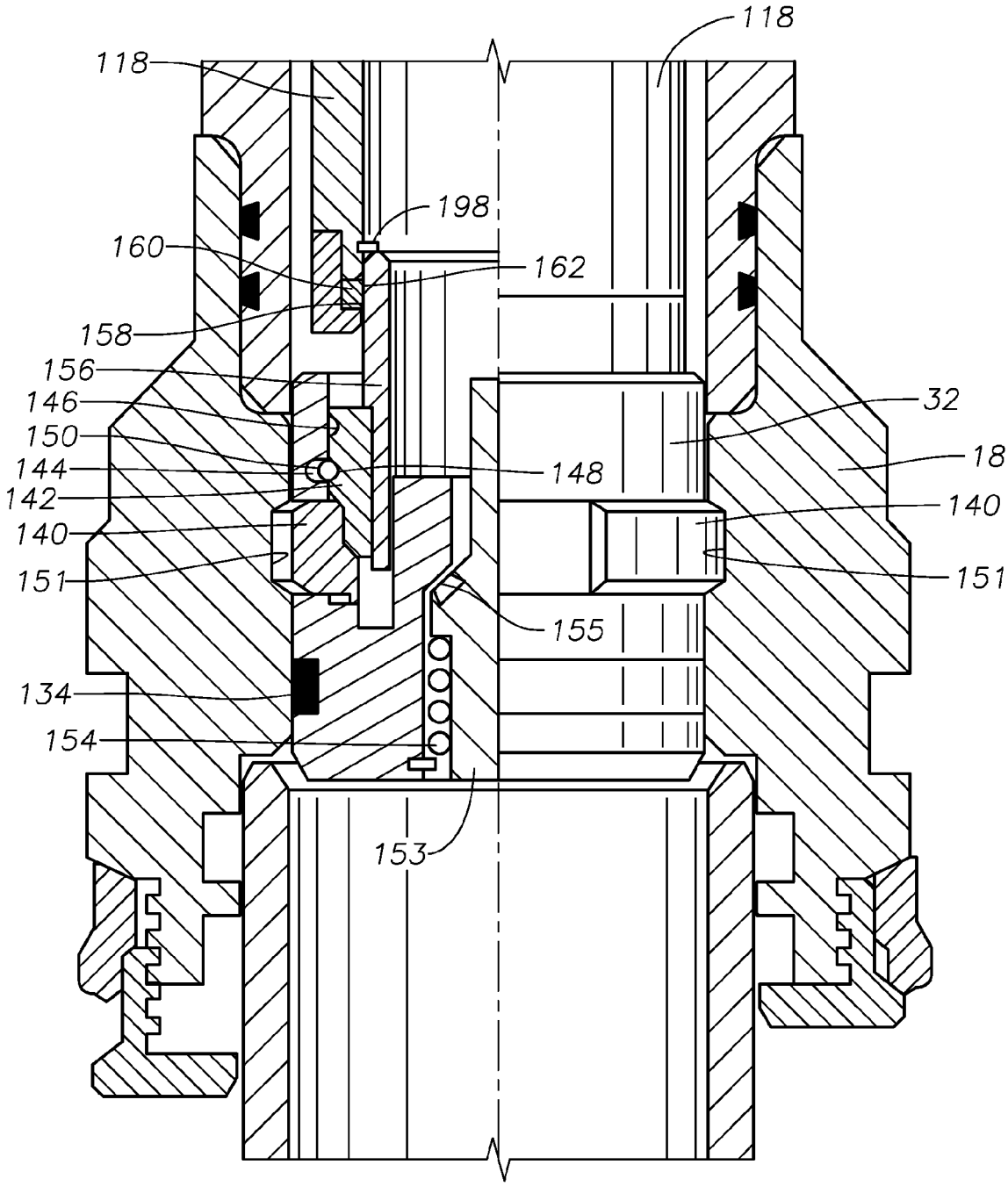
FIG. 6 is a split sectional view of the plug, seal adapter assembly, and the lower portion of the plug adapter tool, the left side of the figure shows a sectional view of the plug and the right side of the figure shows a side view of the exterior of the plug.

Plug Description:

Referring to FIG. 6, the plug 32 is a cylindrical member used to plug the wellbore at the seal adapter 18. The plug 32 has a cylindrical exterior shape and a seal 134 in a groove around the OD. The plug 32 also has a landing shoulder 136 (FIG. 7) on its OD, which lands on the plug support shoulder 138 (FIG. 7) in the seal adapter 18.

Figure 7:
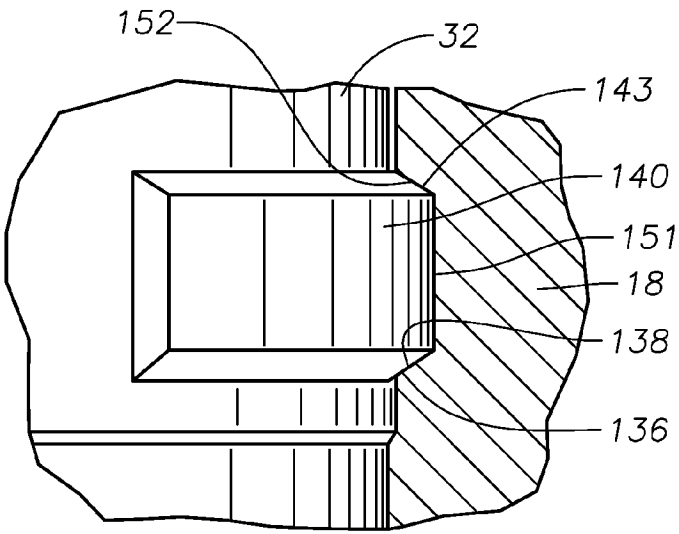
FIG. 7 is an enlarged view of the plug shoulder and dog of FIG. 6.

There are one or more locking elements ("plug dogs") 140, which are blocks similar to the IS lock dogs 42 (FIG. 3) and RT lock dogs 68 (FIG. 3). A plug dog cam 142 is a ring located inside the plug 32 that may travel from an upper position to a lower position. FIG. 6 shows cam 142 in the upper position. In the upper position, the plug dogs 140 are retracted. When the plug dog cam 142 goes to its lower position, the plug dogs 140 are pushed out. The upper edge of the plug dog 140 has a taper 143 (FIG. 7).

There is a plug cam detent groove 144 on an ID in the plug 32. The plug dog cam 142 has an upper detent groove 146 and a lower detent groove 148. The detent 150 is a snap ring that rides in the plug cam detent groove 144. The detent 150 in the lower detent groove 148 holds the plug dog cam 142 in the upper position. When sufficient force is exerted against the plug dog cam 142, the detent 150 pops out of the lower detent groove, allows the plug dog cam 142 to move down, and then enters the upper detent groove 146. When the plug dog cam 142 moves to the lower position, the plug dogs 140 extend to engage the seal adapter groove 151 (FIG. 7). The seal adapter groove has a chamfered upper edge 152 (FIG. 7).

The plug 32 has a check valve 153. Various types of check valves 153 may be used. In an exemplary embodiment, the check valve 153 is a spring loaded damper. A spring 154 pushes up against a seat 155. When the pressure above the check valve 153 exceeds the pressure below check valve 153, the pressure pushes valve 153 downward to allow flow. When the flow stops, the spring 154 pushes up against the seat 155 to close valve 153. If the pressure below check valve 153 exceeds the pressure above check valve 153, the pressure pushes against the seat 155, which remains closed and thus prevents upward flow through the check valve 153. A rod (not shown) attached to the running tool 82 (FIG. 3) or the plug running tool 118 may be used to push check valve 153 downward to release pressure from below prior to removal of the plug 32.

Figure 8:
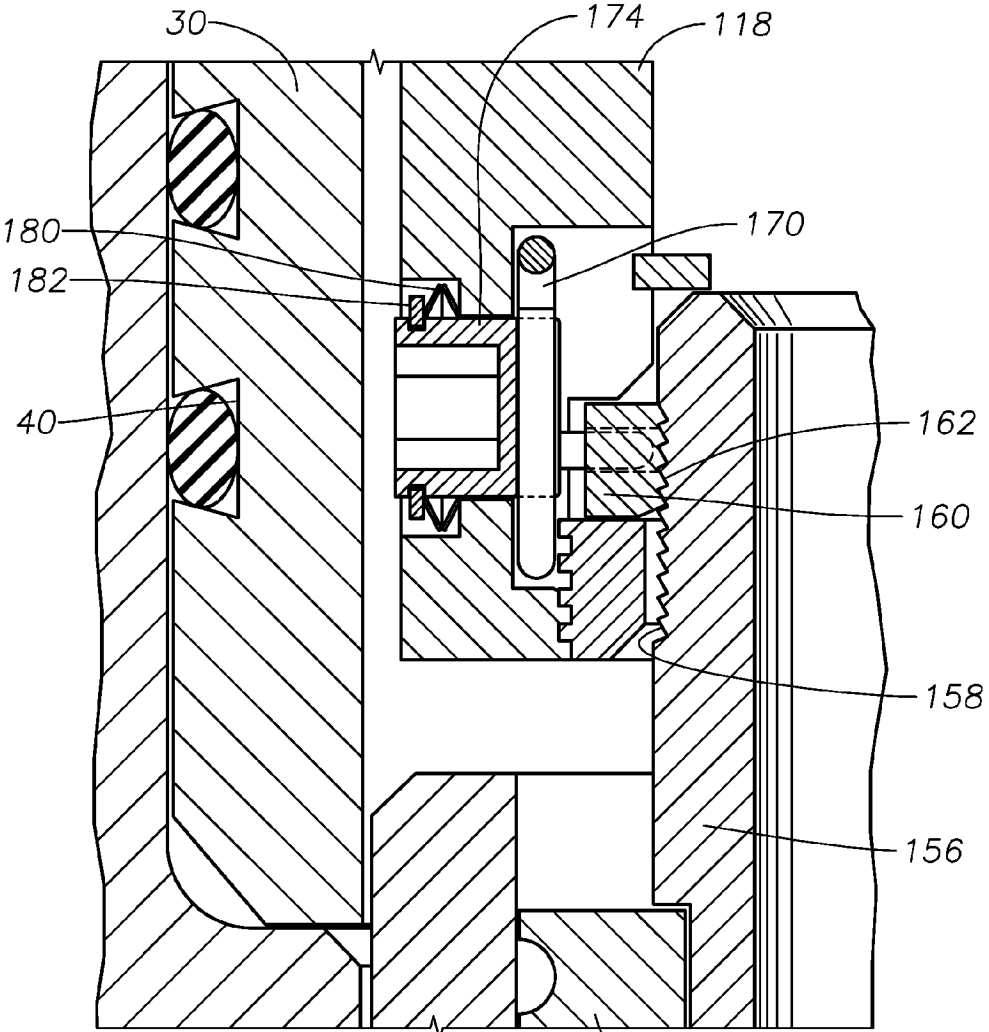
FIG. 8 is a sectional view of the interface between the plug adapter sleeve and the plug of FIG. 6.

The upper end of the plug 32 is attached to a plug running sleeve 156. The OD of the plug running sleeve 156 has plug wickers 158 (detailed view of plug wickers 158 is shown in FIG. 8), which is a set of closely spaced grooves or ridges. Various pitches of the sides of the grooves may be used to establish different engagement and release properties. The plug wickers 158 engage the lower c-ring 160 on the end of the plug adapter tool 118.

Plug Adapter Tool Description:

Referring to FIG. 2, the plug adapter tool 118 is a cylindrical sleeve that has threads 160 at the top for engaging the threads 116 on the RT inner body 84. The lower end of the plug adapter tool 118 has a variable tension connector to attach to and release the plug running sleeve 156 (FIG. 6). Referring to FIG. 8, in one embodiment, a groove on the ID of the plug adapter tool 118 has a plug running c-ring 160 that applies tension to a sawtooth 162. The sawtooth 162 is a set of circumferential grooves on the ID of the c-ring 160. The sawtooth 162 engages the plug wickers 158 to hold the plug running sleeve 156 onto the plug adapter tool 118.

Figure 9:
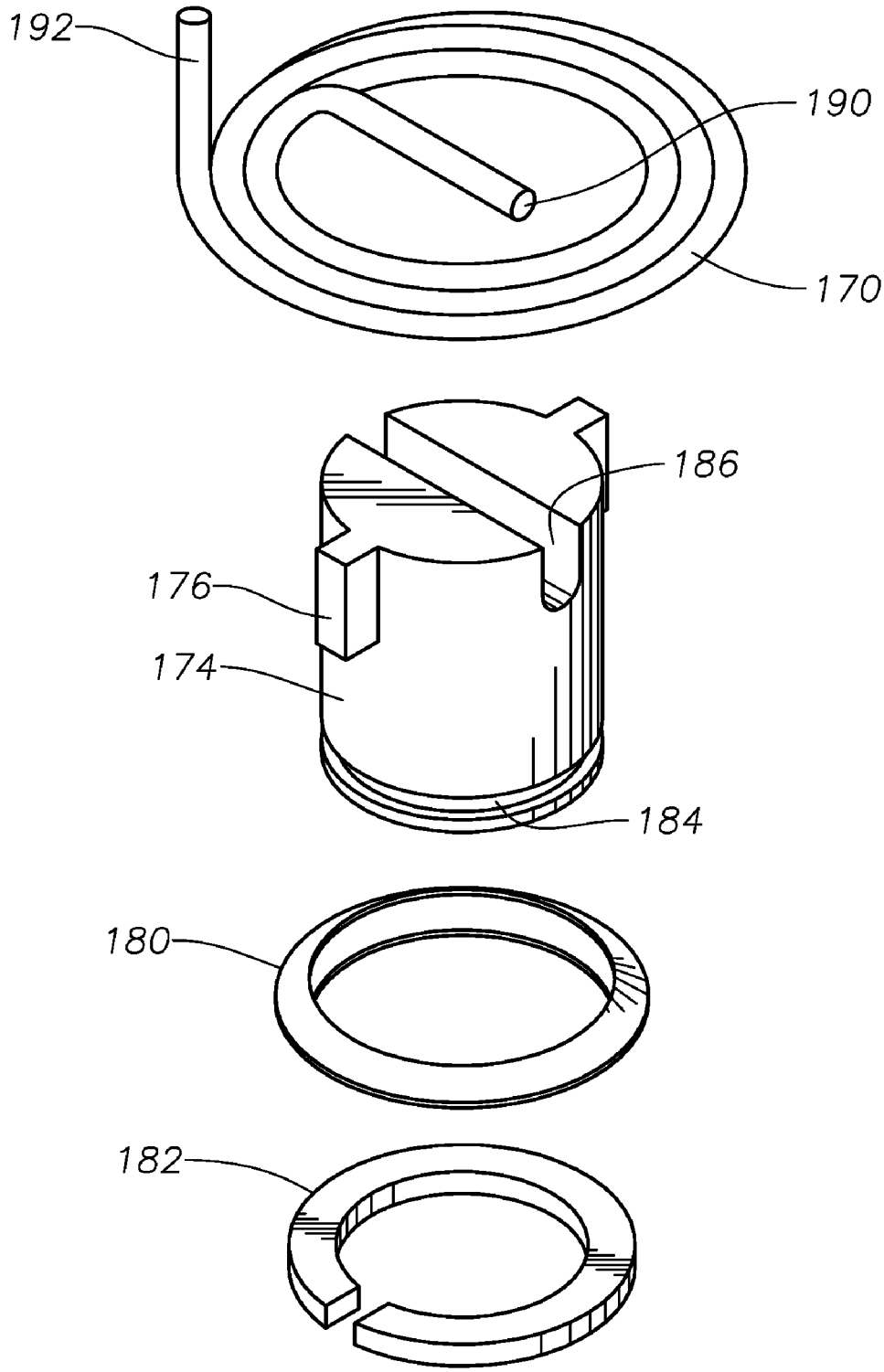
FIG. 9 is an exploded view of the c-ring tension adjustment assembly of FIG. 6.
Figure 10:
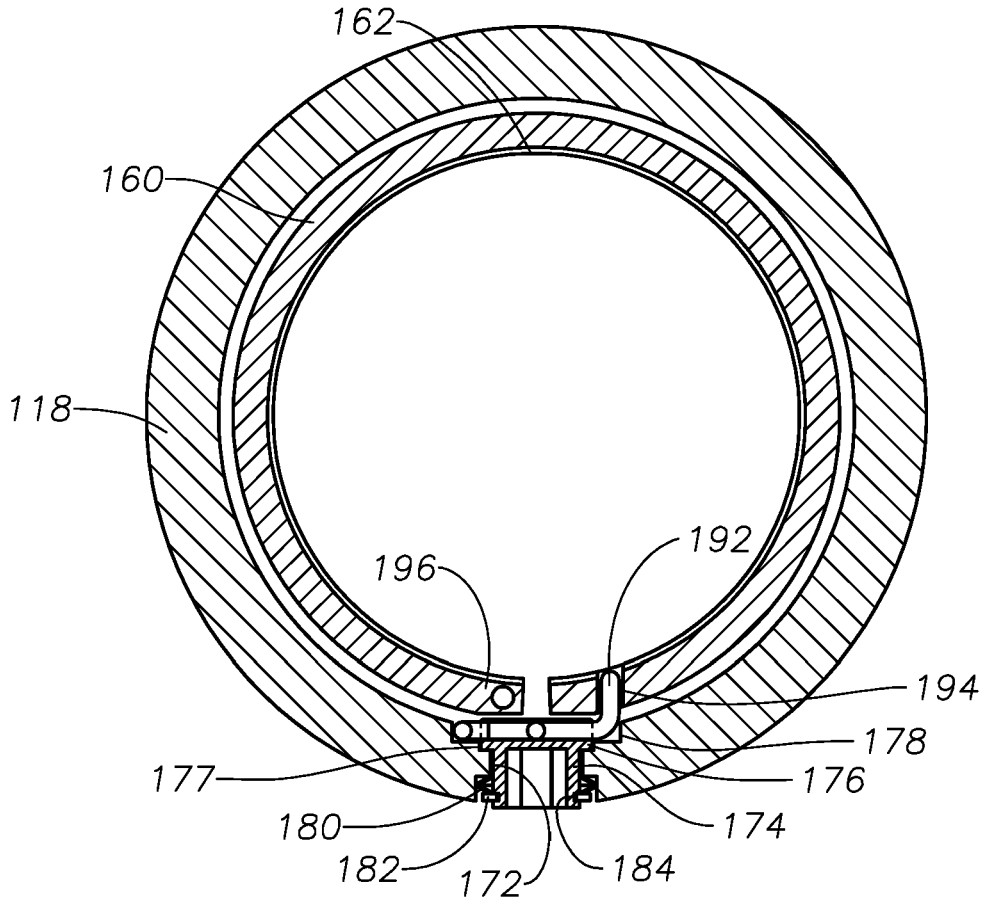
FIG. 10 is a top sectional view of the plug adapter assembly of FIG. 6.

Referring to FIGS. 8-11, a c-ring torsion spring 170 can adjust the tension on the plug running c-ring 160. The plug adapter tool 118 (FIG. 12) has an adjustment assembly bore 172 that is perpendicular to the axis of the plug adapter tool 118. Referring to FIGS. 8 and 9, a lock hub 174 sits inside the bore. The lock hub 174 (FIG. 9) is generally cylindrical and has tangs 176 that fit into lock slots 177.

Figure 12:
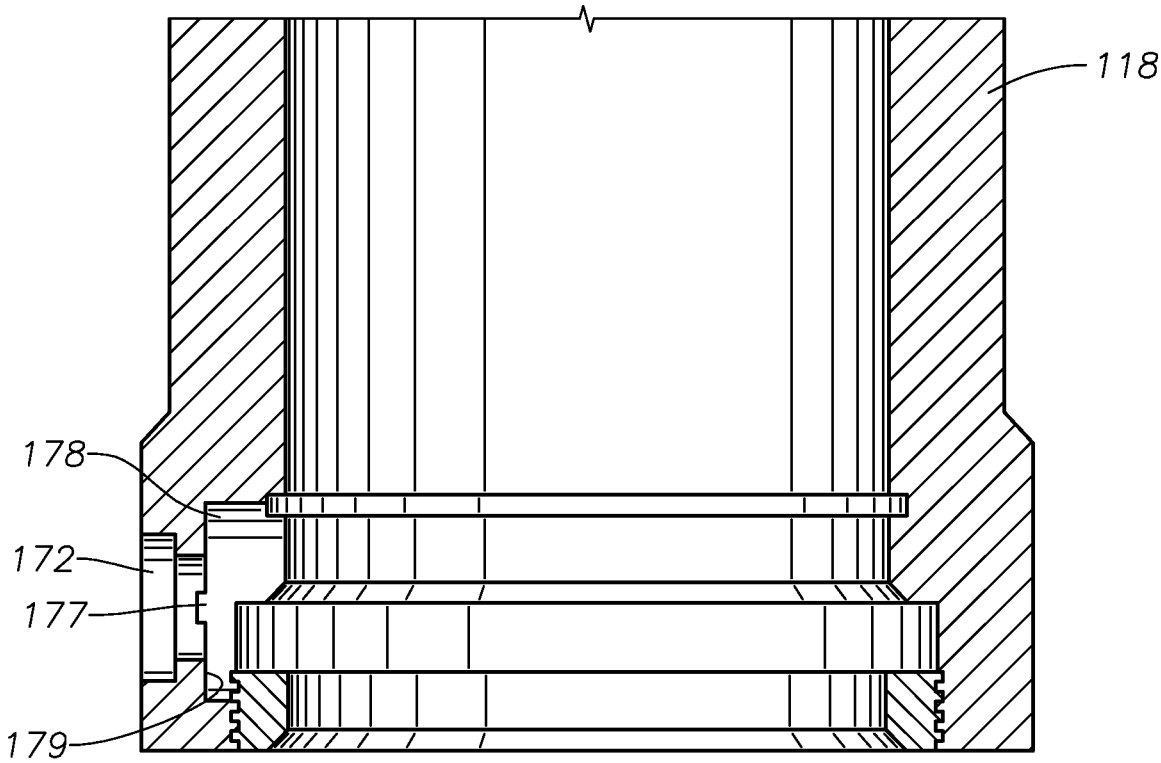
FIG. 12 is a sectional view of the plug adapter tool of FIG. 6.
Figure 13:
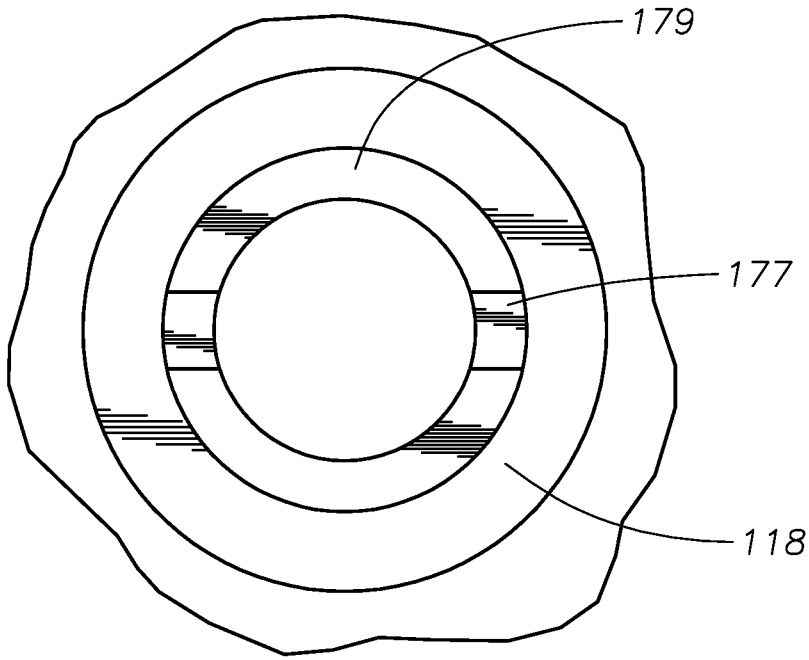
FIG. 13 is a sectional view of the lock tang counterbore of FIG. 11.

The torsion spring counter bore 178 (FIG. 12, 13) is a counter bore created in the ID of the plug adapter tool 118 with a depth that is less than the thickness of the side of the plug adapter tool 118. A lock hub bore 172, which has a diameter smaller than the torsion spring counter bore 178, begins at the bottom of the torsion spring counter bore and extends through the OD wall of the plug adapter tool 118. The shoulder face 179 has two diametrically opposed lock tang slots 177 (FIG. 13). The lock tang slot 177 is a groove that is large enough to receive the lock tang 176.

The lock hub 174 is inserted through the torsion spring counter bore 178, into the lock hub bore 172. Then the spring 180 goes on the lock hub 174 from the outside of the plug adapter 118. The snap ring 182 fits in a snap ring groove 184 on the lock hub 174 to hold the spring 180 in place. The spring 180, retained by the snap ring 182, prevents the lock hub 174 from passing back through the ID of the plug adapter 118. The tangs 176 prevent the lock hub 174 from falling out of the OD of the plug adapter 118.

The spring 180 pushes against the lock hub 174 to keep the tangs 176 in the lock slots 177. The operator is able to push the lock hub 174 with a hex-key wrench (not shown) to disengage the tangs 176 from the lock slots 177, thereby freeing the lock hub 174 to rotate.

Figure 11:
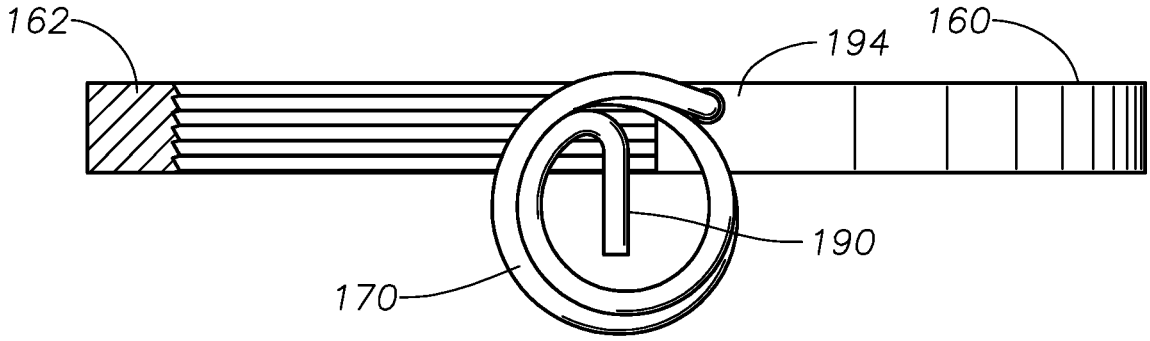
FIG. 11 is a side view of the c-ring and torsion spring of FIG. 6.

The lock hub spring engagement slot 186 is a slot on the interior face of the hub 174, opposite of the face with the hex wrench opening, that is perpendicular to the axis of the lock hub 174. The torsion spring 170 is a spring that applies greater tension when it is twisted or torqued in a particular direction. One end of the torsion spring 170 is bent into a straight segment 190, wherein the axis of the straight segment 190 is perpendicular to the axis of the spring coil (FIG. 11). The other end of the torsion spring 170 is parallel to the axis of the spring coil, forming an engagement rod 192 that engages the plug running c-ring 160. The straight segment 190 of the torsion spring 170 rides in the hub spring engagement slot 186.

The operator is able to adjust tension on the plug running c-ring 160 from a high tension setting to a low tension setting. To change the tension from high to low, the operator depresses and rotates the lock hub 174 with a hex-key wrench. The rotation of the lock hub 174 rotates the straight segment 190 of the torsion spring 170, which in turn causes torque on the torsion spring 170 and pushes the engagement rod 192 end of the spring out from the axis of the spring coil. Thus the increased torque on the torsion spring 170 applies force to the spring end 194 of the plug running c-ring 160, causing the spring end 194 to move away from the fixed end 196. When the spring end 194 moves away from the fixed end 196, the plug running c-ring 160 becomes less tight, and thus causes the sawtooth 162 to apply less force to the plug wickers 158.

When the lock hub 174 is rotated 90 degrees, the tangs 176 align with the lock tang slots 177. The operator can then release the pressure on the lock hub 174, allowing the spring 180 to push the lock hub 174 back out so that the tangs 176 engage the lock tang slots 177. The tangs 176 prevent the lock hub 174 from rotating out of its current position.

Referring to FIG. 6, a plug retainer 198 is a retainer or snap ring on the ID of the adapter sleeve 118. The plug retainer 198 lands on the top of the plug 32, thus stopping the downward motion of the adapter sleeve at the appropriate point.

Operational Description:

Referring to FIG. 3, to insert the running tool ("RT") 82 into the isolation sleeve 30, support the isolation sleeve ("IS") 30 outside of the wellbore. One way of doing this is to suspend the IS 30 (FIG. 1) above the adapter assembly 22 after it is coupled to tubing head 10. The operator attaches a weight 112 to the RT 82, then lowers the weight 112 through the IS 30 and lowers the running tool 82 into the IS 30. The weight 112 could be 300-400 pounds. The weight 112 is a cylindrical piece of steel with a threaded end that screws into the threaded connector 110 at the bottom of the RT inner body 84. As it is lowered, the RT outer sleeve 86 contacts the IS lock sleeve 58. As force is applied on the RT inner body 84 due to weight 112, outer sleeve 86 remains stationary against IS lock sleeve 58 as the RT inner body 84 moves down in relation to IS 30.

Referring to FIG. 4, as the RT inner body 84 moves down, the lock cam retainer 132 pushes against RT lock cam 88, which in turn (1) compresses cam return spring 130 and (2) forces RT lock dogs 68 out. The RT lock dogs 68 engage groove 66 in the IS lock sleeve 58. As the RT inner body 84 moves down relative to the RT outer sleeve 86, locking c-ring 96 is compressed until it is pushed out of the upper groove 108 in the outer sleeve 86, and then it re-expands to support a lower edge 109 in the RT outer sleeve 86. Locking c-ring 96 provides sufficient resistance to keep the cam return spring 130 compressed and prevent the RT lock dogs 68 from disengaging when downward force is removed from the RT inner body 84.

IS retainer ring 56 remains in the lower detent groove 64 of IS lock sleeve 58, thus holding the IS lock sleeve 58 in the upper position relative to the IS 30 during the RT 82 insertion process. IS lock dogs 42 remain retracted as long as the IS lock sleeve 58 is in the upper position.

Referring to FIG. 5, the assembly comprising the IS 30, the RT 82, and the weight 112 is lowered on a cable (not shown) through the fracturing tree valve 22 and through the blow-out preventer ("BOP") (if present).

The IS 30 lands on seal adapter 18 (FIG. 2). The IS 30 remains stationary as the weight 112 continues to pull the RT 82 down. As the weight pulls the RT 82 down, force is transferred through the RT dogs 68 and RT outer sleeve 86 to the IS lock sleeve 58. The weight against IS lock sleeve 58 forces the IS retainer ring 56 out of the lower detent 64.

When the IS retainer ring 56 is out of the lower detent 64, the IS lock sleeve 58 moves down relative to the IS 30 until the IS retainer ring 56 engages the upper detent 62 and the lock sleeve rests on the shoulder 76 of the lock sleeve counterbore 74. As the IS lock sleeve 58 moves down relative to the IS 30, the IS lock sleeve 58 pushes the IS lock dogs 42 outward. The IS lock dogs 42 engage groove 50 (FIG. 1) in the gate valve bore 28.

The IS 30 has one or more seals (not shown) located in one or more seal adapter grooves 40 (FIG. 2). The seals (not shown) engage a sealing surface on the seal adapter 18 and on the gate valve bore 28.

After IS 30 has been installed, as shown on the left side of FIG. 1, the operator pulls up on the cable (not shown) attached to RT 82. The IS lock dogs 42 hold the IS 30 in place in the tubing head 10, as shown on the right side of FIG. 1. The IS retainer ring 56 holds IS lock sleeve 58 in place against the IS 30, as shown in FIG. 5. The locking c-ring 96 provides less resistance than the IS retainer ring 56 and thus the locking c-ring 96 yields to the upward pull of the cable, allowing the RT 84 to move up relative to the RT outer sleeve 86.

When the RT 84 moves up: (1) the locking c-ring 96 snaps into the groove 108 in the RT outer sleeve 86; (2) the cam return spring 130 expands; (3) the RT lock cam 88 moves up relative to outer sleeve 86; and (4) the RT lock dogs 68 are able to retract. As the cable continues to pull up, the chamfered upper shoulder of the RT dog groove 66 pushes against RT lock dogs 68, causing the RT lock dogs to retract into the RT outer sleeve 86. The RT 82 and the weight 112 are withdrawn from the wellbore.

The operator may then run the plug 32 (FIG. 1). Outside of the wellbore, the upper end of the plug adapter tool 118 (FIG. 2) is attached to the lower end of RT 82 (FIG. 2). The plug adapter tool 118 has threaded connections 160 on the ID of its top end 160 that attach to a threaded connection 116 on the OD of the running tool body 84. Referring to FIG. 6, the plug running c-ring 160 is set to its expanded position so that the sawtooth 162 applies just enough force to hold the wickers 158 of the plug adapter tool 118. The plug adapter tool 118 is attached to the plug running sleeve 156.

The RT lock cam 88 (FIG. 3) is locked in the up position by locking c-ring 96. Thus the cam return spring 130 is expanded, the RT lock cam 88 is in the up position, and the RT lock dogs 68 are retracted. The adjustable c-ring 160 (FIG. 6) is adjusted to its "loose" position, which is sufficient to support the weight of the plug 32.

Referring to FIGS. 6 and 7, the operator lowers the RT 82 (FIG. 2) with the plug 32 through the fracturing tree valve 22, as shown in FIG. 1, and continues lowering the assembly until the plug 32 lands in the tubing hanger seal sub 18 as shown in FIG. 6. The RT 82 (FIG. 2) and plug 32 assembly may be lowered on a cable or on a rod (not shown). The plug landing shoulder 136 (FIG. 7) on the plug 32 lands on the plug support shoulder 138 of the seal adapter 18, stopping the downward movement of the plug 32. The weight of the RT 82 and plug adapter tool 118 is transferred through the plug running sleeve 156 to the plug dog cam 142. This forces the plug cam detent 150 out of the lower groove as the plug cam 142 moves down in relation to the plug 32. The plug cam 142 pushes the plug dogs 140 out to engage the seal adapter groove 151. The plug cam detent 150 engages the plug upper detent groove 146, which holds the plug cam 142 in place. The plug 32 has a seal 134 that engages a sealing surface on the ID of tubing hanger seal sub 18.

To remove the RT 82, the operator pulls up on the cable (not shown) that is attached to the RT 82. Due to the loose setting of adjustable c-ring 160, the sawtooth 162 provides less resistance against the plug wickers 158 than the resistance detent 150 provides against the upper detent groove 146. Thus the running tool extension 118 is able to disengage the plug running sleeve 156. The RT 82 and running tool extension 118 are withdrawn from the tubing head 10 on the cable (not shown). The IS 30 and the plug 32 (if used) remain in place. The IS 30 may be used without the plug 32, and the plug 32 may be used without the IS 30.

The operator may proceed to fracture the well. The high pressure fluid flows through IS sleeve 30 and plug 32. IS 30 isolates valve 16 from the high pressure. After the fracturing operations have been completed, the operator may use a rod to push on the check valve 153 to relieve the pressure differential.

To retrieve the plug 32, the RT extension 118 is attached to the RT 82. The compression lock hub 174 (FIG. 9) is turned to relax the c-ring compression spring 170. This allows the plug running c-ring 160 to contract, which will apply more pressure on the sawtooth 162.

The RT 82 and RT extension 118 are lowered on a cable into tubing head 10 until the sawtooth 162 engages the plug wickers 158. The operator then withdraws the cable. Due to the relaxed c-ring compression spring 170, the sawtooth 162 now engages the wickers 158 with greater force than the detent 150 engages the plug upper detent groove 146. Thus as the plug dog cam 142 is pulled up, the plug dogs 140 are retracted, and the plug 32 is free to be withdrawn.

Referring to FIG. 3, to retrieve the IS 30, the RT 82 is configured without the RT extension 118. The c-ring lock 100 is adjusted to expand the locking c-ring 96 to provide greater resistance against the RT outer sleeve 86 than the IS retainer ring 56 provides against the IS lock sleeve 58. Weight 112 is attached to the RT 82.

The RT 82 and weight 112 are lowered on a cable through the fracturing tree valve 22 (FIG. 1) to the IS 30. As the RT 82 passes into the bore of IS 30, the RT outer sleeve 86 contacts the IS lock sleeve 58. As the weight 112 pulls down on the RT 84, outer sleeve 86 remains stationary against IS lock sleeve 58 while RT 84 moves down in relation to IS 30.

As RT body 84 moves down, the lock cam retainer 132 pushes against RT lock cam 88, which in turn (1) compresses cam return spring 130 and (2) forces RT lock dogs 68 out. The RT lock dogs 68 engage a groove 66 on the IS lock sleeve 58. As the RT 84 continues to move down relative to the RT outer sleeve 86, locking c-ring 96 is compressed, pushed out of the upper outer body groove 108, and then re-expands to support lower edge 109 on the RT outer sleeve 86.

The operator then retracts the cable (not shown). The cable pulls up on the RT inner body 84. As the cable pulls up, the force is transferred from the RT inner body 84 to the IS lock sleeve 58 by the lock dogs 68. The resistance of the locking c-ring 96 is greater than the resistance of the IS retainer ring 56, so when the RT lock dogs 68 pull against the IS lock sleeve 58, the detent 56 will pop out of the upper detent groove 62 on the IS lock sleeve 58 as the IS lock sleeve 58 moves up relative to the IS 30. After the IS lock sleeve 58 moves up, lifting force is transferred to the IS 30. The upward pull of the IS 30 causes the IS lock dogs 42 to press against the tapered surface at the top of the gate valve bore groove 50 on the valve assembly bore 28 (FIG. 1), causing the IS lock dogs 42 to retract into the IS 30 (FIG. 4). With the lock dogs 42 retracted from the groove 50 on the fracturing tree valve 22, the IS 30 and RT 5 assembly is free to be withdrawn from the fracturing tree valve.

While the invention has been shown or described in only some of its forms, it should be apparent to those skilled in the art that it is not so limited, but is susceptible to various changes without departing from the scope of the invention.

I claim:

1. An apparatus for protecting a bore of a wellhead member comprising:

a tubular adapter assembly having an inner diameter and selectively securable to the wellhead member, a sleeve having an internal passage, a first seal adapted to form a seal against the inner diameter of the tubular adapter assembly, and a second seal adapted to form a seal against an adapter coupled to an end of a length of casing;

a locking mechanism adapted to secure the sleeve to the tubular adapter assembly the locking mechanism comprising an axially-movable locking member, wherein the locking mechanism is disengaged from the tubular adapter assembly when the axially-movable locking member is located in a first axial position and is engaged with the tubular adapter assembly when the axially-movable locking member is located at a second axial position and a retaining member adapted to maintain the axially-movable member in each of the first position and the second position relative to the sleeve.

2. The apparatus of claim 1, further comprising a plug assembly adapted to pass through the sleeve and secure to the adapter coupled to an end of a length of casing.

3. The apparatus of claim 2, wherein the plug assembly comprises a check valve assembly adapted to enable a flow of fluid from the internal passage of the sleeve to the adapter assembly.

4. The apparatus of claim 1, wherein the tubular adapter assembly comprises a groove adapted to receive a radially-movable locking member to secure the sleeve to the adapter assembly.

5. The apparatus of claim 1, wherein the locking mechanism comprises a radially-movable locking member movable between an inward position and an outward position, wherein the axially-movable locking member urges the radially-movable locking member from the inward position to the outward position as the axially-movable member is moved from the first position to the second position.

6. The apparatus of claim 1, further comprising a weight, wherein the weight urges the axially-movable locking member from the first position to the second position.

7. The apparatus of claim 6, further comprising a wireline-deployed running tool securable to the axially-movable locking member, wherein the running tool has weight sufficient to overcome the retaining member and move the axially-movable locking member from the first position to the second position.

8. The apparatus of claim 7, further comprising a running tool selectively-securable to the sleeve, wherein the running tool comprises:

a locking element movable between an inward position and an outward position to engage the sleeve; and an adjustable tensioning device adapted to provide a variable force to urge the locking element outward towards the outward position, wherein the adjustable tensioning device may be adjusted between a first outward force and a second outward force greater than the first outward force.

9. A wellhead apparatus, comprising:

a tubular adapter assembly that is selectively securable to a wellhead member having a bore;

an isolation sleeve adapted to be disposed within the bore of the wellhead member, the isolation sleeve having a locking mechanism comprising an axially moveable locking member and radially moveable locking members, the axially moveable locking member moving from a first position to a second position in response to a downward vertical force on the axially moveable locking member and the radially moveable locking members move radially outward, into engagement with the wellhead member, in response to the axially moveable locking member moving from the first position to the second position, an internal passage, a first seal adapted to seal against the inner diameter of the tubular adapter assembly, and a second seal adapted to seal against a seal adapter coupled to an end of a length of casing;

a retaining member adapted to maintain the axially moveable locking member in each of the first and the second position relative to the isolation sleeve; and a running tool that detachably engages the isolation sleeve to dispose the isolation sleeve into the bore of the wellhead member.

10. The apparatus of claim 9, further comprising:

a plug, the plug being detachably engaged to the running tool;

a seal adapter in the bore of the wellhead member;

wherein the running tool causes the plug to disengage from the running tool and engage the seal adapter.

11. The apparatus of claim 10, wherein the outer diameter of the plug is smaller than the internal passage of the isolation sleeve.

12. The apparatus of claim 10, wherein the running tool reengages the plug in response to the running tool being lowered into the wellhead.

13. The apparatus of claim 9, wherein a vertical force on the running tool causes the running tool to disengage from the isolation sleeve.

14. The apparatus of claim 13, wherein the running tool reengages the isolation sleeve in response to the running tool being lowered into the bore of the wellhead member.

15. A method for protecting a wellhead member comprising:

attaching a running tool to an isolation sleeve, the isolation sleeve having an internal passage, and a first seal disposed proximate to a first end of the sleeve;

deploying the running tool and isolation sleeve through an adapter assembly into a bore in the wellhead member;

landing the isolation sleeve in a casing adapter coupled to an end of a length of casing to form a seal between the second seal and the casing adapter and couple the internal passage of the sleeve to the interior of the length of casing; and latching the isolation sleeve to the adapter assembly to secure the isolation sleeve to the adapter assembly by using a weight suspended from the running tool to exert downward force on the running tool and axially displacing the running tool in a first direction relative to the isolation sleeve.

16. The method of claim 15, further comprising disengaging the running tool from the isolation sleeve by applying a lifting force to the running tool.

17. The method of claim 16, further comprising:

lowering the running tool into the wellhead member;

engaging the plug with the running tool;

lifting the running tool with the plug attached out of the wellhead member; and wherein the plug disengages the wellhead member in response to pulling upward on the running tool.

18. The method of claim 15, further comprising:

attaching a plug to the running tool;

deploying the plug through the adapter assembly and the isolation sleeve;

latching the plug within the casing adapter; and applying a force to the running tool to disengage the running tool from the plug.

19. The method of claim 15, wherein deploying the running tool and isolation sleeve comprises lowering the running tool and isolation sleeve via a wireline.

20. The method as recited in claim 15, wherein attaching a running tool to an isolation sleeve comprises setting a tension adjustment on the running tool to establish a first minimum force to disengage the running tool from the isolation sleeve when deploying the running tool and isolation sleeve though the adapter assembly into the bore of the wellhead member.

21. The method of claim 20, further comprising:

setting the tension adjustment on the running tool to establish a second minimum force, greater than the first minimum force, to disengage the running tool from the isolation sleeve when the running tool is attached to the isolation sleeve;

deploying the running tool into the adapter assembly to attach the running tool to the isolation sleeve; and applying a force less than the second minimum force to the running tool to unlatch the isolation sleeve from the adapter assembly.

22. An apparatus for protecting a bore of a wellhead member comprising:

a sleeve adapted to extend from a bore of an adapter assembly secured to the wellhead member, through the bore of the wellhead member, to a casing adapter coupled to a length of easing;

a first seal disposed on the sleeve and adapted to form a seal between the sleeve and the bore of the adapter assembly secured to the wellhead member;

a radially movable locking member adapted to selectively engage the adapter assembly to secure the sleeve to the adapter assembly;

an axially movable locking member movable between a first axial position, wherein the radially movable locking member is disengaged from the adapter assembly, and a second axial position, wherein the axially movable locking member urges the radially movable locking member outward to engage the adapter assembly and a retaining member adapted to maintain the axially movable locking member in each of the first axial position and the second axial position.

23. The apparatus as recited in claim 22, further comprising a running tool selectively-securable to the sleeve, wherein the running tool comprises:

a locking element movable between an inward position and an outward position to engage the sleeve; and an adjustable tensioning device adapted to provide a variable force to urge the locking element outward towards the outward position, wherein the adjustable tensioning device may be adjusted between a first outward force and a second outward force greater than the first outward force.

24. The apparatus as recited in claim 22, wherein the axially movable locking member is adapted to be axially positioned by a wireline deployed running tool.

25. The apparatus as recited in claim 22, comprising a second seal disposed on the sleeve and adapted to form a seal between the sleeve and the casing adapter coupled to a length of casing.

* * * * *